US010508316B2

(12) United States Patent
Cui et al.

(10) Patent No.: US 10,508,316 B2
(45) Date of Patent: Dec. 17, 2019

(54) METHOD AND FIXTURE FOR COUNTERACTING TENSILE STRESS

(71) Applicant: GENERAL ELECTRIC COMPANY, Schenectady, NY (US)

(72) Inventors: Yan Cui, Greer, SC (US); Srikanth Chandrudu Kottilingam, Greenville, SC (US); Brian Lee Tollison, Honea Path, SC (US); Brian Leslie Henderson, Simpsonville, SC (US); Cem Murat Eminoglu, Simpsonville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 280 days.

(21) Appl. No.: 15/475,661

(22) Filed: Mar. 31, 2017

(65) Prior Publication Data

US 2018/0282829 A1 Oct. 4, 2018

(51) Int. Cl.
*C21D 1/30* (2006.01)
*C22F 1/10* (2006.01)
(Continued)

(52) U.S. Cl.
CPC ..... *C21D 1/30* (2013.01); *C22F 1/08* (2013.01); *C22F 1/10* (2013.01); *C22F 1/183* (2013.01); *F05D 2230/40* (2013.01)

(58) Field of Classification Search
CPC ... C21D 1/30; B23Q 3/063; C22F 1/08; C22F 1/10; C22F 1/183; F05D 2230/40
See application file for complete search history.

(56) References Cited

U.S. PATENT DOCUMENTS 2,261,878 A 11/1941 Hathaway
4,951,390 A * 8/1990 Fraser ..... B23K 37/0443 29/402.21
(Continued)

FOREIGN PATENT DOCUMENTS

GB 2098119 A 11/1982
GB 2506494 A 4/2014
(Continued)

OTHER PUBLICATIONS

Agilent Technologies, Laser and Optics User's Manual (order No. p/n 05517-90045). Santa Clara, CA, 2002 (Year: 2002).*
(Continued)

*Primary Examiner* — Kevin E Yoon
*Assistant Examiner* — Ryan L Heckman
(74) *Attorney, Agent, or Firm* — McNees Wallace & Nurick LLC

(57) ABSTRACT

A method for counteracting tensile stress in an article is disclosed, including heating the article and applying compressive stress to the article along a compressive stress vector, the compressive stress vector including a compressive stress vector component opposite in direction to a tensile stress vector of a thermally-induced tensile stress of the article. The compressive stress is applied by thermally-induced autogenous pressure by a fixture contacting the article. A fixture for counteracting tensile stress is disclosed, including a first compression member and a second compression member, and a position lock connecting the first compression member to the second compression member and reversibly fixing the first compression member relative to the second compression member. The first compression member and the second compression member include compressive surfaces having mating conformations for surfaces
(Continued)

of an article. The position lock includes a material composition.

19 Claims, 4 Drawing Sheets

(51) Int. Cl.
*C22F 1/18* (2006.01)
*C22F 1/08* (2006.01)

(56) References Cited

U.S. PATENT DOCUMENTS

| | | | | |
|---|---|---|---|---|
| 5,100,050 | A | 3/1992 | Krueger et al. | |
| 5,710,405 | A | 1/1998 | Solomon et al. | |
| 6,158,955 | A * | 12/2000 | Caddell, Jr. | B23K 9/162 29/889.1 |
| 7,361,015 | B2 | 4/2008 | Shimizu et al. | |
| 8,206,646 | B2 | 6/2012 | Lo et al. | |
| 8,226,885 | B2 | 7/2012 | Ebner et al. | |
| 9,120,151 | B2 | 9/2015 | Godfrey et al. | |
| 9,481,594 | B2 | 11/2016 | Gaubil et al. | |
| 9,580,325 | B2 | 2/2017 | Zhamu et al. | |
| 2014/0161618 | A1* | 6/2014 | Walker | B23K 15/0006 416/223 A |
| 2016/0316522 | A1 | 10/2016 | Matsen et al. | |

FOREIGN PATENT DOCUMENTS

| | | | | |
|---|---|---|---|---|
| JP | 1988111935 | A | 11/1989 | |
| JP | 4505779 | B2 | 7/2010 | |
| WO | WO-2008107660 | A1 * | 9/2008 | C21D 1/42 |

OTHER PUBLICATIONS

Capobianco, Thomas & Hanson, Michael. (2005). Auger Spectroscopy Results from Ductility Dip Cracks Opened Under Ultra-High Vacuum (Year: 2005).*

* cited by examiner

METHOD AND FIXTURE FOR COUNTERACTING TENSILE STRESS

FIELD OF THE INVENTION

The present invention is directed to methods and fixtures for counteracting tensile stress. More particularly, the present invention is directed to methods and fixtures for counteracting tensile stress with compressive stress applied by thermally-induced autogenous pressure.

BACKGROUND OF THE INVENTION

Certain alloys, such as superalloys, austenitic stainless steels, copper alloys, titanium alloys, refractory alloys, non-weldable alloys, and hard-to-weld alloys, may have a tendency to experience strain age cracking during heating within a temperature range wherein the alloy exhibits reduced ductility. The occurrence of strain age cracking in this temperature range, known sometimes as a ductility dip range, may result in articles formed from these alloys having undesirability high fail rates during high-temperature processing such as heat treatments. Additionally during heat treatments and processing of certain articles, the articles may experience thermally-induced distortion due to thermal expansion of the alloys constituting the articles.

Many heat treatment cycles for articles formed from such alloys, including certain gas turbine components, take place within furnaces which limit or exclude the possibility of performing actions on the articles while the articles are being treated, thereby preventing practicable action from being taken which might reduce or prevent strain age cracking or thermally-induced distortion.

BRIEF DESCRIPTION OF THE INVENTION

In an exemplary embodiment, a method for counteracting tensile stress in an article includes heating the article and applying compressive stress to the article. The compressive stress is applied along a compressive stress vector including a compressive stress vector component opposite in direction to a tensile stress vector of a thermally-induced tensile stress of the article. The compressive stress is applied by thermally-induced autogenous pressure applied by a fixture contacting the article.

In another exemplary embodiment, a fixture for counteracting tensile stress includes a first compression member, a second compression member, and a first position lock. The first compression member includes a first compressive surface. The second compression member includes a second compressive surface. The first position lock connects the first compression member to the second compression member and reversibly fixes the first compression member relative to the second compression member. The first compressive surface includes a first mating conformation for a first surface of an article and the second compressive surface includes a second mating conformation for a second surface of the article, wherein the first surface of the article is distal to the second surface of the article across a first portion of the article. The first compressive surface and the second compressive surface are oriented relative to one another to apply compressive stress to the article by thermally-induced autogenous pressure. The position lock includes a first material composition.

Other features and advantages of the present invention will be apparent from the following more detailed description of the preferred embodiment, taken in conjunction with the accompanying drawings, which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided are exemplary methods and fixtures for counteracting tensile stress. Embodiments of the present disclosure, in comparison to methods and articles not utilizing one or more features disclosed herein, decrease costs, increase part life, increase yield, decrease strain age cracking, decrease thermally-induced distortion, decrease high preheat temperatures, or a combination thereof.

Figure 1:
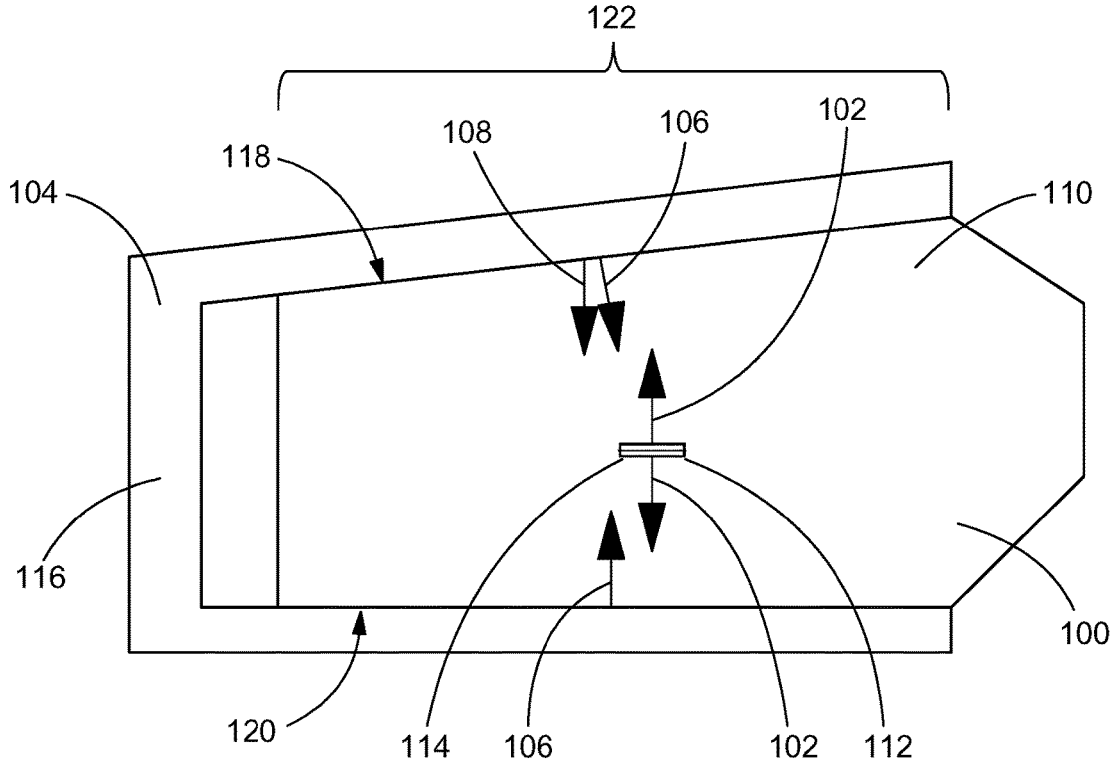
FIG. 1 is a schematic view of an article and fixture for counteracting tensile stress, according to an embodiment of the present disclosure.

Referring to FIG. 1, in one embodiment, an article 100 includes a tensile stress vector 102 of a thermally-induced tensile stress of the article 100. A method for counteracting the tensile stress includes contacting the article 100 with a fixture 104, and heating the article 100 with the fixture 104 in contact with the article 100. The fixture 104 applies a compressive stress to the article 100 along a compressive stress vector 106, wherein the compressive stress vector 106 includes a compressive stress vector component 108 opposite in direction to the tensile stress vector 102. The compressive stress is applied by thermally-induced autogenous pressure.

In one embodiment, the magnitude of the compressive stress vector component 108 is at least about 50% of the magnitude of the tensile stress vector 102, alternatively at least about 60%, alternatively at least about 65%, alternatively at least about 70%, alternatively at least about 75%, alternatively at least about 80%, alternatively at least about 85%, alternatively at least about 90%, alternatively at least about 95%, alternatively at least about equal to (about 100%), alternatively at least about 105%, alternatively at least about 110%, alternatively at least about 115%, alternatively at least about 120%, alternatively at least about 125%.

Figure 2:
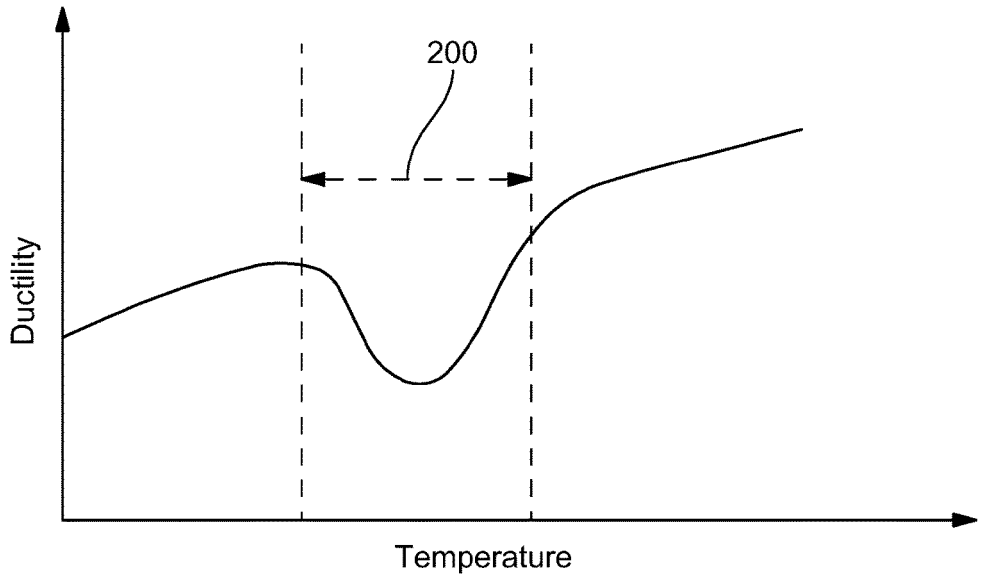
FIG. 2 is a schematic illustration of ductility of an article material as a function of temperature, according to an embodiment of the present disclosure.

The tensile stress vector 102 may arise from thermal expansion of an article alloy 110 as the article 100 is subjected to heating. In one embodiment, if unchecked, the tensile stress vector 102 would distort the article 100. Referring to FIGS. 1 and 2, in another embodiment, the tensile stress vector 102 exceeds the ductility of the article alloy 100 due to the heating of the article 100 occurring within the ductility dip range 200 of the article 100, which, if unchecked, may lead to strain age cracking.

The ductility dip range 200 may depend upon the composition of the article alloy 110. In one embodiment, the ductility dip range 200 is between about 1,100° F. to about 1,600° F., alternatively between about 1,200° F. to about 1,700° F., alternatively between about 1,500° F. to about 1,700° F., alternatively between about 1,300° F. to about 1,600° F., alternatively between about 1,400° F. to about 1,700° F.

Heating the article 100 may include any suitable heating regime, including, but not limited to, at least one of a heat treatment, a pre-weld heat treatment, a weld heat treatment, an aging heat treatment, a solutioning heat treatment, a stress reduction heat treatment, a tempering heat treatment, and annealing heat treatment, a post-weld heat treatment, a brazing thermal cycle, a coating process, or combinations thereof. In one embodiment, the heating of the article 100 occurs with the article disposed partially or entirely within a furnace.

The article 100 may be any suitable object, including, but not limited, a turbine component. Suitable turbine components include, but are not limited to, hot gas path components, buckets (also known as blades) (see FIG. 5), nozzles (also known as vanes) (see FIGS. 3 and 4), shrouded buckets (also known as shrouded blades), combustors, shrouds, transition pieces, combustion liners, or combinations thereof.

The article 100 may include any suitable article alloy 110, including, but not limited to, an article alloy 110 selected from the group consisting of superalloys, nickel-based superalloys, cobalt-based superalloys, iron-based superalloys, non-weldable alloys, hard-to-weld alloys, refractory alloys, austenitic stainless steel, copper alloys, titanium alloys, GTD 111, GTD 262, GTD 444, INCONEL 100, INCONEL 738, INCONEL 939, MAR-M-247, MGA 2400, René 108, and combinations thereof.

Hard-to-weld alloys, such as nickel-based superalloys and certain aluminum-titanium alloys, due to their gamma prime and various geometric constraints, are susceptible to gamma prime strain aging, liquation and hot cracking. These materials are also difficult to join when the gamma prime phase is present in volume fractions greater than about 30%, which may occur when aluminum or titanium content exceeds about 3%. As used herein, a "hard-to-weld alloy" is an alloy which exhibits liquation, hot and strain-age cracking, and which is therefore impractical to weld. Non-weldable alloys, are typically precipitation hardenable or solid-solution strengthened alloys which cannot be practically welded in an industrial setting and at an industrial scale, are only weldable under prohibitively extreme conditions, and, as such, are generally regarded as not being weldable. As used herein, a "non-weldable alloy" refers to alloys having titanium-aluminum equivalents (or combined percentages of composition, by weight) of about 4.5 or higher. Non-weldable alloys may include nickel-based alloys in which the primary hardening mechanism is via the process of precipitation, cobalt alloys which are solid solution strengthened, and alloys which require heating immediately prior to and during welding to at least about 1,000° C.

As used herein, "GTD 111" refers to an alloy including a composition, by weight, of about 14% chromium, about 9.5% cobalt, about 3.8% tungsten, about 4.9% titanium, about 3% aluminum, about 0.1% iron, about 2.8% tantalum, about 1.6% molybdenum, about 0.1% carbon, and a balance of nickel.

As used herein, "GTD 262" refers to an alloy including a composition, by weight, of about 22.5% chromium, about 19% cobalt, about 2% tungsten, about 1.35% niobium, about 2.3% titanium, about 1.7% aluminum, about 0.1% carbon, and a balance of nickel.

As used herein, "GTD 444" refers to an alloy including a composition, by weight, of about 7.5% cobalt, about 0.2% iron, about 9.75% chromium, about 4.2% aluminum, about 3.5% titanium, about 4.8% tantalum, about 6% tungsten, about 1.5% molybdenum, about 0.5% niobium, about 0.2% silicon, about 0.15% hafnium, and a balance of nickel.

As used herein, "INCONEL 100" refers to an alloy including a composition, by weight, of about 10% chromium, about 15% cobalt, about 3% molybdenum, about 4.7% titanium, about 5.5% aluminum, about 0.18% carbon, and a balance of nickel.

As used herein, "INCONEL 738" refers to an alloy including a composition, by weight, of about 0.17% carbon, about 16% chromium, about 8.5% cobalt, about 1.75% molybdenum, about 2.6% tungsten, about 3.4% titanium, about 3.4% aluminum, about 0.1% zirconium, about 2% niobium, and a balance of nickel.

As used herein, "INCONEL 939" refers to an alloy including a composition, by weight, of about 0.15% carbon, about 22.5% chromium, about 19% cobalt, about 2% tungsten, about 3.8% titanium, about 1.9% aluminum, about 1.4% tantalum, about 1% niobium, and a balance of nickel.

As used herein, "MAR-M-247" refers to an alloy including a composition, by weight, of about 5.5% aluminum, about 0.15% carbon, about 8.25% chromium, about 10% cobalt, about 10% tungsten, about 0.7% molybdenum, about 0.5% iron, about 1% titanium, about 3% tantalum, about 1.5% hafnium, and a balance of nickel.

As used herein, "MGA 2400" refers to an alloy including a composition, by weight, of about 19% cobalt, about 19% chromium, about 1.9% aluminum, about 3.7% titanium, about 1.4% tantalum, about 6% tungsten, about 1% niobium, about 0.1% carbon, and a balance of nickel.

As used herein, "René 108" refers to an alloy including a composition, by weight, of about 8.4% chromium, about 9.5% cobalt, about 5.5% aluminum, about 0.7% titanium, about 9.5% tungsten, about 0.5% molybdenum, about 3% tantalum, about 1.5% hafnium, and a balance of nickel.

Referring to FIG. 1, in one embodiment, the article 100 includes a feature 112 which generates the thermally-induced tensile stress. The feature 112 may be any feature 112 which generates tensile stress with increasing temperature, including, but not limited to a weld 114. In a further embodiment, the weld 114 is a repair weld which has replaced a crack or other undesirable element. In addition to or in lieu of the feature 112, the thermally-induced stress may be generated by residual stress due welding, thermal stress due to different thicknesses, thermal stress due to dissimilar materials, thermal stress due to differential thermal expansion, volume change due to phase transformation, gamma prime evolution, or combinations thereof.

The fixture 104 may apply the compressive stress to the article 100 by thermally-induced autogenous pressure through any suitable arrangement. In one embodiment, compressive stress is generated, at least in part by a first material composition 116 of the fixture 104.

The first material composition 116 may include any suitable material, including, but not limited to, martensitic stainless steel, 410SS, 416SS, 431SS, carbon steel, 1018 steel, 4340 steel, precipitated stainless steel, 17PH SS, CMC, supermartensitic stainless steel, super 13 chrome, X80, zirconium, or combinations thereof.

In one embodiment, the first material composition 116 undergoes a first phase transformation from body-centered cubic to face-centered cubic within a first phase transformation temperature range, the first phase transformation contracting the first material composition 116 and applying the compressive stress to the article 100. The first material composition 116 undergoing the first phase transformation from body-centered cubic to face-centered cubic may include any suitable material, including, but not limited to, martensitic stainless steel, 410SS, 416SS, 431SS, carbon steel, 1018 steel, 4340 steel, precipitated stainless steel, 17PH SS, supermartensitic stainless steel, super 13 chrome, X80, zirconium, or combinations thereof. By way of example, martensitic stainless steel 416SS transitions to an austenite microstructure commencing at about 1,470° F. and finishing at about 1,582° F., and so in the temperature range increasing from about 1,470° F. to about 1,582° F., the physical structure of 416SS contracts with increasing temperature rather than expanding, and martensitic stainless steel 1018SS transitions to an austenite microstructure commencing at about 1,300° F. and finishing at about 1,525° F., and so in the temperature range increasing from about 1,300° F. to about 1,525° F., the physical structure of 1018SS contracts with increasing temperature rather than expanding.

The first phase transformation temperature range may be any suitable range, including, but not limited to between about 1,100° F. to about 1,600° F., alternatively between about 1,200° F. to about 1,700° F., alternatively between about 1,500° F. to about 1,700° F., alternatively between about 1,300° F. to about 1,600° F., alternatively between about 1,400° F. to about 1,700° F. In one embodiment, the first phase transformation temperature range includes end points which are within about 10° F. of the endpoints of the ductility dip range 200 (see FIG. 2), alternatively within about 75° F., alternatively within about 50° F., alternatively within about 25° F., alternatively within about 15° F., alternatively within about 10° F., alternatively within about 5° F.

In another embodiment, the fixture 104 includes a first material composition 116 which includes a lower thermal expansion coefficient than the article 100, and expands less than the article 100 during the heating. The differential thermal expansion of the first material composition 116 and the article 100 effectively applies a compressive stress to the article 100. The first material composition 116 including the lower thermal expansion coefficient relative to the article 100 may include any suitable material, including, but not limited to, CMC.

As used herein, "410SS" refers to an alloy including a composition, by weight, of about 12.5% chromium, and a balance of iron.

As used herein, "416SS" refers to an alloy including a composition, by weight, of about 13% chromium, and a balance of iron.

As used herein, "431SS" refers to an alloy including a composition, by weight, of about 16% chromium, about 2% Nickel, and a balance of iron.

As used herein, "1018 steel" refers to an alloy including a composition, by weight, of about 0.17% carbon, about 0.75% manganese, and a balance of iron.

As used herein, "4340 steel" refers to an alloy including a composition, by weight, of about 0.4% carbon, about 0.7% manganese, about 1.8% nickel, about 0.8% chromium, about 0.25% molybdenum, about 0.23% silicon, and a balance of iron.

As used herein, "17PH SS" refers to an alloy including a composition, by weight, of about 16.25% chromium, about 4% nickel, about 4% copper, about 0.3% niobium and tantalum, and a balance of iron.

As used herein, "CMC" refers to a ceramic matrix composite. Suitable CMC compositions may include, but are not limited to, aluminum oxide-fiber-reinforced aluminum oxides (Ox/Ox), carbon-fiber-reinforced carbon (C/C), carbon-fiber-reinforced silicon carbides (C/SiC), silicon-carbide-fiber-reinforced silicon carbides (SiC/SiC), carbon-fiber-reinforced silicon nitrides ($C/Si_3N_4$), or combinations thereof.

As used herein, "Super 13 Chrome" refers to an alloy including a composition, by weight, of about 12.5% chromium, about 5.75% nickel, about 2.25% molybdenum, and a balance of iron.

As used herein, "X80" refers to an alloy including a composition, by weight, of about 0.05% carbon, about 1.75% manganese, about 0.17% silicon, about 0.21% chromium, about 0.17% molybdenum, and a balance of iron.

Figure 3:
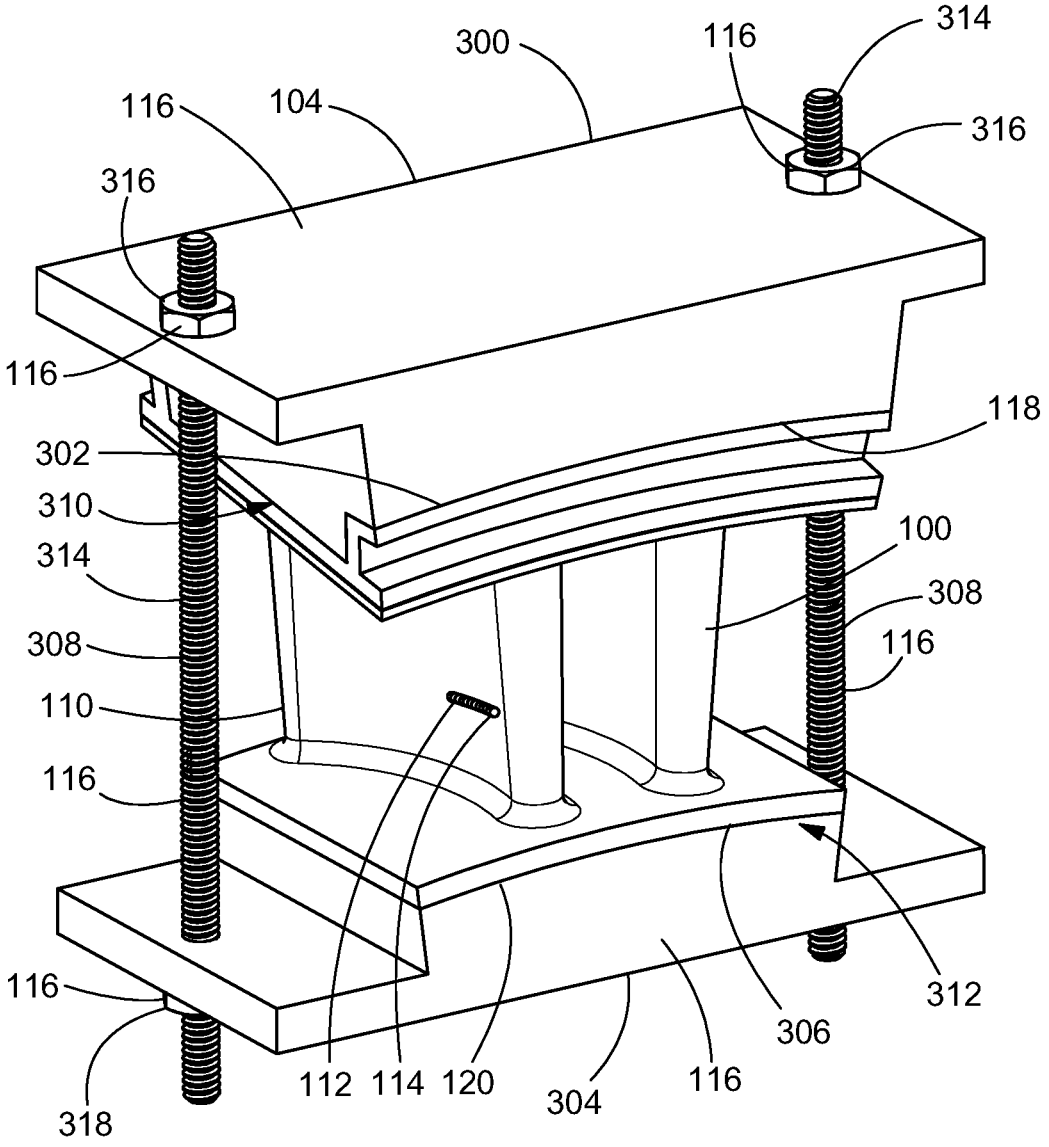
FIG. 3 is a perspective view of an article and fixture for counteracting tensile stress, according to an embodiment of the present disclosure.

Referring to FIG. 3, in one embodiment, the fixture 104 for counteracting tensile stress includes a first compression member 300 having a first compressive surface 302, a second compression member 304 having a second compressive surface 306, and a first position lock 308. The first position lock 308 connects the first compression member 300 to the second compression member 304 and reversibly fixes the first compression member 300 relative to the second compression member 304. The first position lock 308 includes the first material composition. The first compressive surface 302 includes a first mating conformation 310 for a first surface 118 of the article and the second compressive surface 306 includes a second mating conformation 312 for a second surface 120 of the article 100, wherein the first surface 118 of the article 100 is distal to the second surface 120 of the article 100 across a first portion 122 of the article 100. The first compressive surface 302 and the second compressive surface 306 are oriented relative to one another to apply compressive stress to the article 100 by thermally-induced autogenous pressure.

In one embodiment, the first mating conformation 310 is essentially matched to the first surface 118, the second mating conformation 312 is essentially matched to the second surface 120, or both. "Essentially matched" indicates at least a 75% identify between the topologies.

The method for counteracting the tensile stress may include contacting the first compression member 300 to the first surface 118, contacting the second compression member 304 to the second surface 120, reversibly locking the first position lock 308 to fix the first compression member 300 relative to the second compression member 304, and heating the first material composition 116 and the article 100 to apply the compressive stress to the article 100. In one embodiment, applying the compressive stress to the article 100 includes the heating effecting the first phase transformation, contracting the first position lock 308. In another embodiment, applying the compressive stress to the article 100 includes the first material composition 116 thermally expanding less than the article 100 while the first position lock 308 maintains the position of the first compression member 300 and the second compression member 304 relative to the one another and the article 100, effectively compressing the article 100.

In one embodiment, the first position lock 308 includes a bolt 314, a first nut 316, and a second nut 318. The first compression member 300 and the second compression member 304 are disposed on the bolt 314 such that the first compression member 300 is between the first nut 316 and the second compression member 304 along the bolt 314, and the second compression member 304 is between the second nut 318 and the first compression member 300 along the bolt 314. The first position lock 308 may include a plurality of bolts 314, with each of the plurality of bolts 314 having a first nut 316 and a second nut 316.

In one embodiment, the bolt 314 includes the first material composition 116. The first nut 316, the second nut 318 may each, independently, include the first material composition 116 or another suitable composition.

The method for counteracting the tensile stress may include tightening the first nut 316 against the first compression member 300 and the second nut 318 against the second compression member 304 to reversibly lock the first position lock 308.

Figure 4:
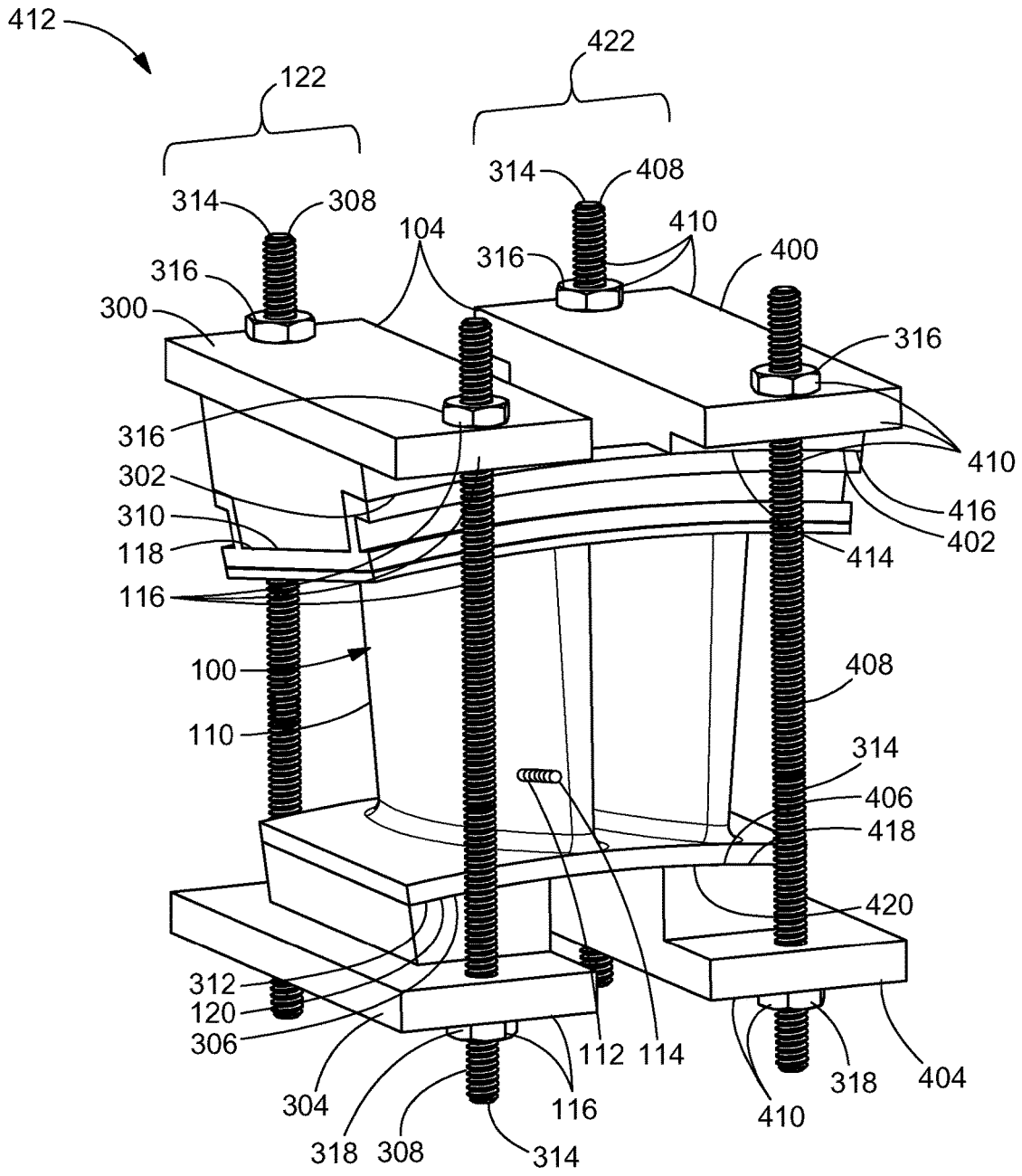
FIG. 4 is a perspective view of an article and parallel fixture for counteracting tensile stress, according to an embodiment of the present disclosure.
Figure 5:
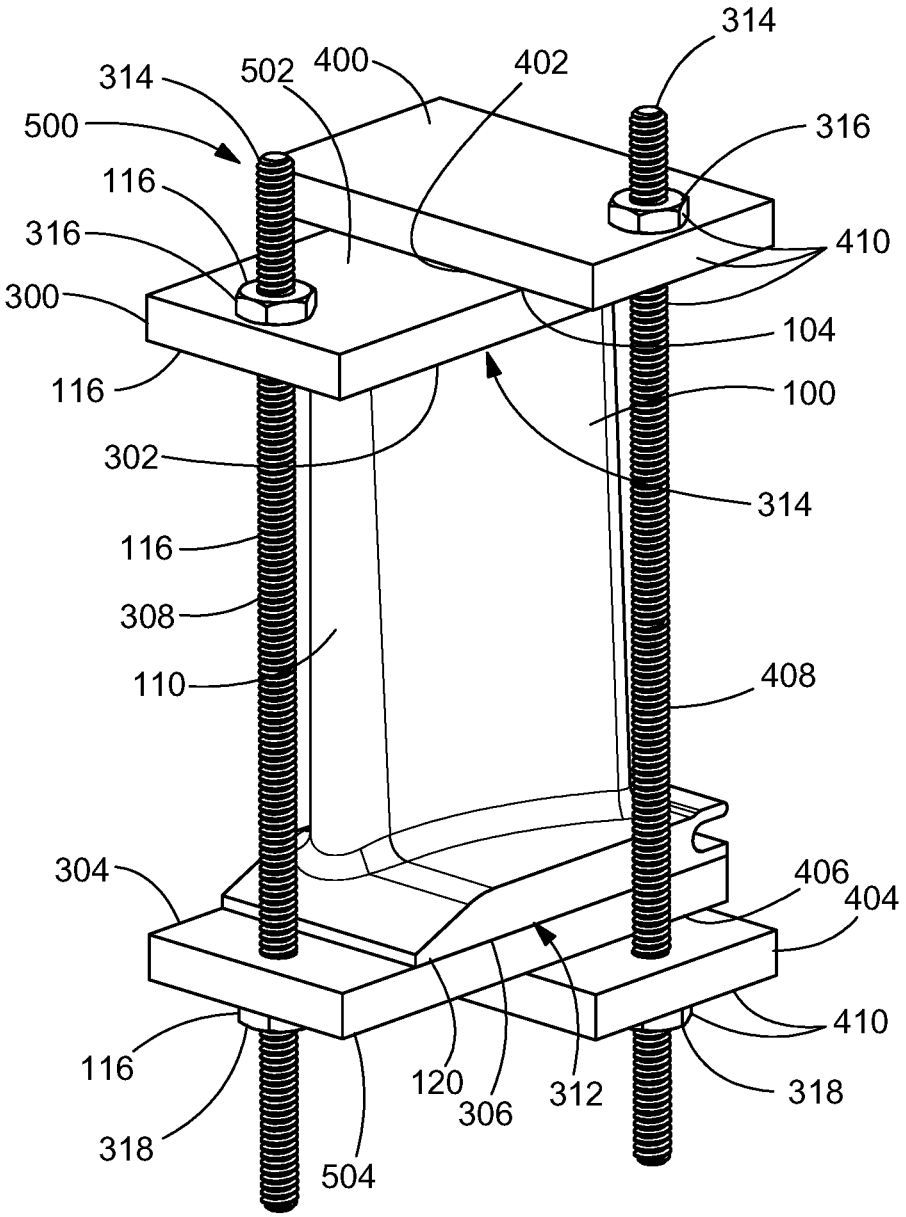
FIG. 5 is a perspective view of an article and serial fixture for counteracting tensile stress, according to an embodiment of the present disclosure.

Referring to FIGS. 4-5, in one embodiment, the fixture 104 includes a third compression member 400 having a third compressive surface 402, a fourth compression member 404 having a fourth compressive surface 406, and a second position lock 408. The second position lock 408 connects the third compression member 400 to the fourth compression member 404 and reversibly fixes the third compression member 400 relative to the fourth compression member 404. The second position lock 408 includes a second material composition 410.

In one embodiment, the second material composition 410 includes a second phase transformation from body-centered cubic to face-centered cubic distinct from the first phase transformation. The second phase transformation temperature range may be any suitable range, including, but not limited to between about 1,100° F. to about 1,600° F., alternatively between about 1,200° F. to about 1,700° F., alternatively between about 1,500° F. to about 1,700° F., alternatively between about 1,300° F. to about 1,600° F., alternatively between about 1,400° F. to about 1,700° F. In one embodiment, the first phase transformation temperature range includes end points which are within about 10° F. of the endpoints of the ductility dip range 200 (see FIG. 2), alternatively within about 75° F., alternatively within about 50° F., alternatively within about 25° F., alternatively within about 15° F., alternatively within about 10° F., alternatively within about 5° F.

In another embodiment, the second material composition 410 includes a lower thermal expansion coefficient than the article 100, and expands less than the article 100 during the heating. The differential thermal expansion of the second material composition 410 and the article 100 effectively applies a compressive stress to the article 100.

The second material composition 410 may include any suitable material, including, but not limited to, martensitic stainless steel, 410SS, 416SS, 431SS, carbon steel, 1018 steel, 4340 steel, precipitated stainless steel, 17PH SS, CMC, supermartensitic stainless steel, super 13 chrome, X80, zirconium, or combinations thereof, provided that the second material composition 410 is distinct from the first material composition 116.

Referring to FIG. 4, in one embodiment, which may be referred to as a parallel fixture 412, the third compressive surface 402 includes a third mating conformation 414 for a third surface 416 of the article 100 and the fourth compressive surface 406 includes a fourth mating conformation 418 for a fourth surface 420 of the article 100, wherein the third surface 416 of the article 100 is distal to the fourth surface 420 of the article 100 across a second portion 422 of the article 100. The presence of the first material composition 116 and the second material composition 410 may counteract differing tensile stresses in different regions of the article 100, or compensate for different morphological effects of the conformation of the article 100.

Referring to FIG. 5, in one embodiment, which may be referred to as a serial fixture 500, the third compressive surface 402 is disposed on a first rear surface 502 of the first compression member 300 and the fourth compressive surface 406 is disposed on a second rear surface 504 of the second compression member 304. The presence of the first material composition 116 and the second material composition 410 may counteract differing tensile stresses in the same region of the article 100, or may effectively combine the first phase transformation temperature range and the second phase transformation temperature range to counteract tensile stresses over a ductility dip range 200 broader that either of the first phase transformation temperature range or the second phase transformation temperature range.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for counteracting tensile stress in an article, comprising:

contacting a first compression member of a fixture having a first compressive surface including a first mating conformation to a first surface of the article;

contacting a second compression member of the fixture having a second compressive surface including a second mating conformation to a second surface of the article;

reversibly locking a first position lock of the fixture connecting the first compression member to the second compression member, fixing the first compression member relative to the second compression member, the first position lock including a first material composition;

heating the article within a furnace; and applying compressive stress to the article along a compressive stress vector, the compressive stress vector including a compressive stress vector component opposite in direction to a tensile stress vector of a thermally-induced tensile stress of the article, wherein the compressive stress is applied by thermally-induced autogenous pressure applied by the fixture contacting the article, and wherein the first material composition includes at least one of:

a first phase transformation from body-centered cubic to face-centered cubic, the first material composition undergoing the first phase transformation during the heating, the first phase transformation contracting the first position lock and applying the compressive stress to the article; or lower thermal expansion coefficient than the article, the first material composition expanding less than the article during the heating, applying the compressive stress to the article.

2. The method of claim 1, wherein the first material composition includes the first phase transformation from body-centered cubic to face-centered cubic, and the first material composition undergoes the first phase transformation during the heating, the first phase transformation contracting the first position lock and applying the compressive stress to the article.

3. The method of claim 1, wherein the thermally-induced tensile stress is generated by a feature including a thermally-induced decrease in ductility over a ductility dip range, and the first phase transformation occurs within the ductility dip range.

4. The method of claim 3, wherein the ductility dip range is between about 1,200° F. to about 1,700° F.

5. The method of claim 1, wherein the first material composition includes the lower thermal expansion coefficient than the article, and expands less than the article during the heating, applying the compressive stress to the article.

6. The method of claim 1, wherein:

the first position lock includes:

a bolt, the first compression member and the second compression member being disposed on the bolt;

a first nut; and a second nut, the first compression member being disposed between the first nut and the second compression member along the bolt, and the second compression member being disposed between the second nut and the first compression member along the bolt; and reversibly locking the first position lock includes tightening the first nut against the first compression member and the second nut against the second compression member.

7. The method of claim 1, wherein the article includes an article alloy selected from the group consisting of superalloys, nickel-based superalloys, cobalt-based superalloys, iron-based superalloys, non-weldable alloys, hard-to-weld alloys, refractory alloys, austenitic stainless steel, copper alloys, titanium alloys, GTD 111, GTD 262, GTD 444, INCONEL 100, INCONEL 738, INCONEL 939, MAR-M-247, MGA 2400, René 108, and combinations thereof.

8. The method of claim 1, wherein the heating the article includes at least one of a heat treatment, a pre-weld heat treatment, a weld heat treatment, an aging heat treatment, a solutioning heat treatment, a stress reduction heat treatment, a tempering heat treatment, and annealing heat treatment, a post-weld heat treatment, a brazing thermal cycle and a coating process.

9. A fixture for counteracting tensile stress, comprising:

a first compression member having a first compressive surface;

a second compression member having a second compressive surface; and a first position lock, the first position lock connecting the first compression member to the second compression member and reversibly fixing the first compression member relative to the second compression member, the first position lock including a first material composition, wherein the first compressive surface includes a first mating conformation for a first surface of an article and the second compressive surface includes a second mating conformation for a second surface of the article, the first surface of the article being distal to the second surface of the article across a first portion of the article, the first compressive surface and the second compressive surface being oriented relative to one another to apply compressive stress to the article by thermally-induced autogenous pressure, and wherein the first material composition includes at least one of:

a first phase transformation from body-centered cubic to face-centered cubic such that the first material composition undergoes the first phase transformation during heating, the first phase transformation contracting the first position lock and applying the compressive stress to the article; or a lower thermal expansion coefficient than the article such that the first material composition expands less than the article during heating, applying the compressive stress to the article.

10. The method of claim 1, wherein the first phase transformation occurs between about 1,200° F. to about 1,700° F.

11. The method of claim 1, wherein the article is a turbine component.

12. The method of claim 1, wherein the first material composition is selected from the group consisting of martensitic stainless steel, 410SS, 416SS, 431SS, carbon steel, 1018 steel, 4340 steel, precipitated stainless steel, 17PH SS, CMC, supermartensitic stainless steel, super 13 chrome, X80, zirconium, and combinations thereof.

13. The method of claim 1, wherein the fixture further includes:

a third compression member having a third compressive surface;

a fourth compression member having a fourth compressive surface; and a second position lock, the second position lock connecting the third compression member to the fourth compression member and reversibly fixing the third compression member relative to the fourth compression member, the second position lock including a second material composition.

14. The method of claim 13, further including:

contacting the third compression member having the third compressive surface including a third mating conformation to a third surface of the article;

contacting the fourth compression member having the fourth compressive surface including a fourth mating conformation to a fourth surface of the article; and reversibly locking the second position lock.

15. The method of claim 13, further including:

contacting the third compression member having the third compressive surface including a third mating conformation to a first rear surface of the first compression member;

contacting the fourth compression member having the fourth compressive surface including a fourth mating conformation to a second rear surface of the second compression member; and reversibly locking the second position lock.

16. The method of claim 13, wherein the second material composition includes a second phase transformation from body-centered cubic to face-centered cubic distinct from the first phase transformation, and the second material composition undergoes the second phase transformation during the heating, the second phase transformation contracting the second position lock and applying a second compressive stress to the article.

17. The method of claim 16, wherein the second phase transformation occurs between about 1,200° F. to about 1,700° F.

18. The method of claim 13, wherein the second material composition is distinct from the first material composition, and is selected from the group consisting of martensitic stainless steel, 410SS, 416SS, 431SS, carbon steel, 1018 steel, 4340 steel, precipitated stainless steel, 17PH SS, CMC, supermartensitic stainless steel, super 13 chrome, X80, zirconium, and combinations thereof.

19. The method of claim 13, wherein the second material composition includes a lower thermal expansion coefficient than the article, and expands less than the article during the heating, applying the compressive stress to the article.

* * * * *